US005622307A

United States Patent [19]

Wosje

[11] Patent Number: 5,622,307

[45] Date of Patent: Apr. 22, 1997

[54] RAINPROOF INFORMATION-HOLDING ENVELOPE

[76] Inventor: Michael T. Wosje, 1100 Second Ave., Sioux Falls, S. Dak. 57105

[21] Appl. No.: 513,352

[22] Filed: Aug. 10, 1995

[51] Int. Cl.[6] ..... B65D 27/00; B65D 85/48

[52] U.S. Cl. ..... 229/74; 206/451; 383/9; 383/67

[58] Field of Search ..... 383/9, 22, 25, 383/38, 39, 40, 67, 17, 84; 229/74; 206/425, 449, 451, 452

[56] References Cited

U.S. PATENT DOCUMENTS

| | | | |
|---|---|---|---|
| 1,657,737 | 1/1928 | Bogren | 206/451 |
| 2,077,664 | 4/1937 | Beardsley | 206/451 |
| 2,663,415 | 12/1953 | Roehm | 206/451 |
| 3,151,649 | 10/1964 | Mitchell, Jr. | 383/22 |
| 3,341,003 | 9/1967 | Marsh | 206/451 X |
| 3,554,435 | 1/1971 | Martinez | 383/67 X |
| 4,207,984 | 6/1980 | Kelly et al. | 206/451 X |
| 5,267,643 | 12/1993 | Scribner | 383/17 |

FOREIGN PATENT DOCUMENTS

| | | | |
|---|---|---|---|
| 330464 | 6/1930 | United Kingdom | 206/451 |

*Primary Examiner*—Jes F. Pascua

[57] ABSTRACT

A rainproof container designed for information documents. This container is to be fastened to a product held for sale. The product would normally be free standing and available for inspection and the container might be held in a window or the like on the product.

5 Claims, 1 Drawing Sheet

RAINPROOF INFORMATION-HOLDING ENVELOPE

BACKGROUND AND SUMMARY OF THE INVENTION

The invention pertains to container devices such as an envelope for holding advertising and informational material in place exteriorly of a car or pickup or other object held for sale or lease. The containers are designed to be rainproof so as to protect papers held inside.

Sales of used automobiles, trucks, boats, farm tractors, and other vehicles is common. Even homes are now often sold by their owners. Rather than trading used vehicles in on replacements, it is increasingly common for owners to sell their own used equipment. This invention provides a device designed to provide sale or lease information to prospects. The device may be affixed to the product being sold or leased. Numerous copies of sheets containing pertinent and desirable information about the product and how to access the seller can be inserted into the rainproof container and affixed to the vehicle or other product being sold or leased so that any prospect interested enough may take a sheet. The advantage of this invention over simply leaving an informational sheet attached to the product, particularly where the container is an envelope, is that it provides protection for sheets and allows numerous copies of the materials to be contained within the envelope for access by a plurality of prospects.

The preferred embodiment provides an envelope with unique features especially adaptable to exterior use in variable weather, thus protecting the informational materials. A more complete understanding of the invention in its embodiment may be derived from a study of the figures and the following detailed description.

DESCRIPTION

Briefly, this invention comprises a container whose preferred embodiment is a specialized type of envelope for holding a sheaf of sheets of paper onto the exterior of an item for sale and completely protecting that sheaf from inclement weather while being held there.

Figure 1:
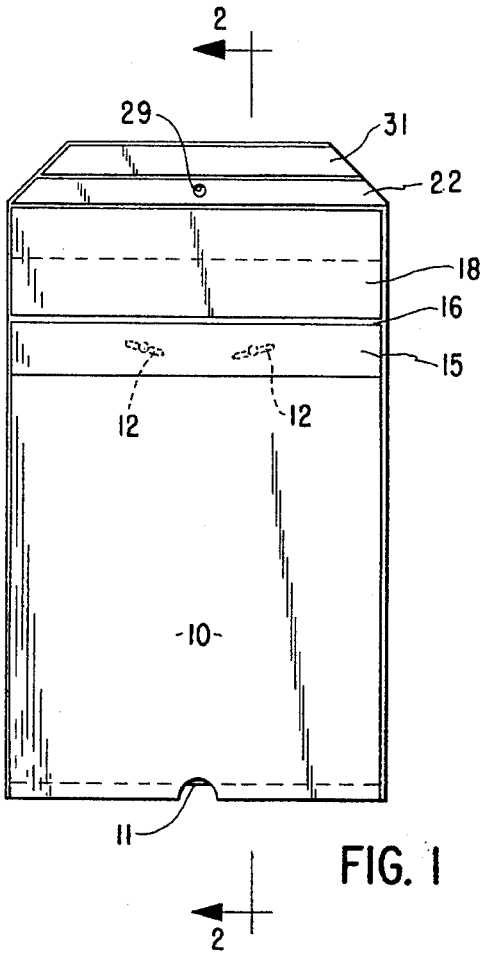
FIG. 1 is a view of an envelope flattened out to show its planform.
Figure 2:
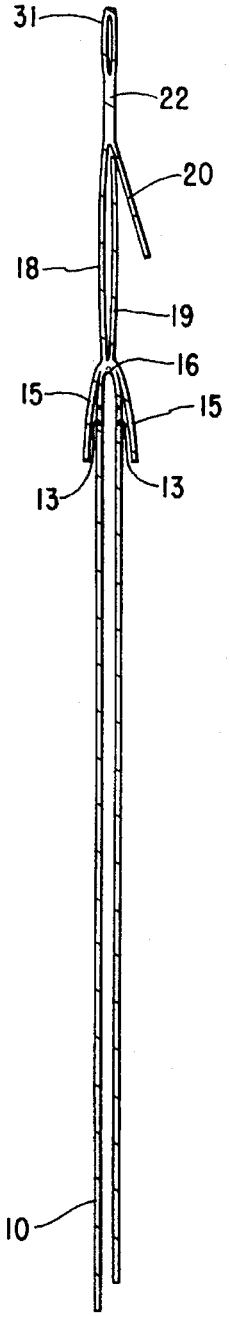
FIG. 2 is a sectional view from line 2—2 of FIG. 1 without the information sheets.
Figure 4:
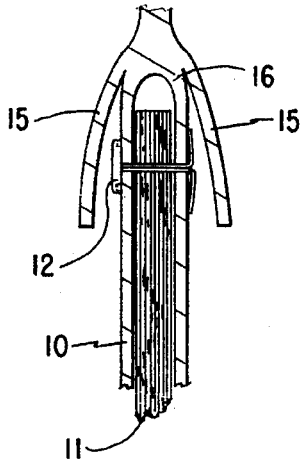
FIG. 4 is a detailed view of the portion of the envelope from the same sectional line as FIG. 2 showing the means for holding the information sheets in place.

More specifically, the envelope includes a lower envelope portion 10 adapted to enclose a sheaf of papers 11. The papers are large enough to include all the information on the vehicle being offered for sale and information as to the name, address, phone number and any other pertinent information on the owner, proposed price, etc. Presently it is envisioned that a usual letter-sized sheet would be adequate. The papers 11 are held in the lower envelope 10 by a split paper clip 12 (FIG. 4) extending through holes 13 (FIG. 2) in the walls of the lower envelope.

To protect the lower envelope, and particularly the holes through which the clips 12 extend, from the weather, a pair of flaps 15 are provided. These flaps may be molded with the envelope and extend downwardly from an upper end seam, 16 of the lower envelope 10.

Above the seam at 16, the envelope is molded to provide a pocket having an outer wall 18 extending upward from the lower envelope to the upper parts of the device. There is also an interior wall 19 attached to the outer wall 18 at the bottom of the pocket and along its sidewalls to form the pocket. Again a protection flap 20 is provided to cover the entire upper opening of the pocket from precipitation, dust or the like which might otherwise enter that pocket.

This pocket is used to enclose a sign indication that the vehicle to which the sign is attached is available for purchase or rental or perhaps other disposition. By use of a pocket, such signs could be interchanged or kept fresh by use of new cardboard bulletins or the like.

Above the pocket and its flap 20, the container is formed to provide an attachment device. The attachment may be by nails or tacks to a house or similar wooden product such as a wood boat. For other devices for sale having only metal or plastic materials on the exterior, some type of adhesive may be needed or a pressure sensitive tape may be used. In the preferred embodiment when the sale object has a window which may be opened and closed, particularly when the window is closed by raising it in channels, the attachment device may be of the type shown in FIG. 3.

Figure 3:
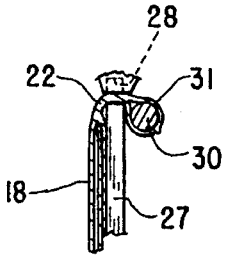
FIG. 3 is a detailed view showing the upper part of the envelope engaged in place on a vehicle window.

In the embodiment shown in FIG. 3, a flat walled web member 22 having a width slightly greater than the thickness of a car window 27 or similar closure device which may run upward into a channel 28. As shown, this web is adapted to be held by the contact between the windows 27 and its channel 28. The figure also shows a hole 29 formed in the web which might be used for holding the envelope to another type of product to be sold when a nail or hook or the like might be available.

In order to hold the device firmly to the window 27, a double-walled opening extending the width of the envelope may be formed. By insertion of a bar 30 such as a dowel, pencil or rod, this opening takes the form of a tube 31 and will prevent the device from slipping out of the window so long as the window opening is smaller than the diameter of the bar 30.

In use, the sheaf or pad of papers 11 is inserted into the lower envelope 10 and clipped in place by using the paper clips 12. A paper or cardboard sign indicating "For Sale" or the like is placed in the pocket defined by the walls 18 and 19. The bar 30 or other retainer is inserted into the tube 31. The entire device is then draped over the window 27 with the web member 22 draped over the edge of the lowered side window 27. That window may then be raised to press against—or even slide into—the channel 28. Whether or not the window will seat into or against the channel 28 will depend on the thickness of the web 22 and the looseness of the fit between window 27 and channel 28. However, that difference is of little significance because the raised window will still be closed tightly enough to the frame to hold the envelope from being removed.

Thus, a relatively secure envelope is provided to hold and to make available, needed information concerning the vehicle to be sold.

It will be obvious that the same device can be used in connection with cars, pickup trucks, and any other vehicle having windows that can be opened and shut. If the window is closed by a hinged arrangement the device can be readily adapted to the different type of window. Thus, it may also be used on the cab of a farm tractor or combine. It is apparent that the device has considerable flexibility.

I claim as my invention:

1. For use with an object to be sold, an envelope device for dispensing informational material, said envelope device comprising a lower, partially enclosed envelope adapted to receive a bundle of information sheets, said lower envelope having front and rear walls, means in connection with at least one of said walls adapted to hold said sheets releasably within said envelope, holding means formed above said envelope adapted to hold said envelope securely to said object to be sold and means to protect the interior of said lower envelope including weather protection flaps formed on said device above said lower envelope to protect said means to hold the sheets from precipitation damage.

2. The envelope device of claim 1 in which said means to hold the sheets includes spindle means extending through holes formed in said walls and engaging said sheets in a manner such that said sheets can be removed from said spindle means.

3. The envelope device of claim 2 in which a pocket is formed on said device above said lower envelope, said pocket including a front wall and a rear wall sealed together on three sides but open at one side to create an opening to said pocket, flap means on said device above said one open side to protect the opening from precipitation.

4. The envelope device of claim 1 in which said object to be sold has at least one window adapted to be opened, said envelope device including a tube formed in the envelope device, a web member to space said tube from said lower envelope, the spacing being at least as great as the thickness of said window, and bar means in said tube to hold said device from being disengaged from said window when said window is closed.

5. The envelope device of claim 4 in which a pocket is formed on said device above said lower envelope and below said web member, said pocket including a front wall and a rear wall sealed together on three sides but open at one side to create an opening to said pocket, flap means on said device above said one open side to protect the opening from precipitation.

* * * * *